US011251510B2

(12) United States Patent
Persson et al.

(10) Patent No.: US 11,251,510 B2
(45) Date of Patent: Feb. 15, 2022

(54) TUNABLE DIPLEXER JUNCTION

(71) Applicant: Telefonaktiebolaget LM Ericsson (publ), Stockholm (SE)

(72) Inventors: Ove Persson, Hunnebostrand (SE); Anatoli Deleniv, Mölndal (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/967,240

(22) PCT Filed: Mar. 9, 2018

(86) PCT No.: PCT/EP2018/055863
§ 371 (c)(1),
(2) Date: Aug. 4, 2020

(87) PCT Pub. No.: WO2019/170246
PCT Pub. Date: Sep. 12, 2019

(65) Prior Publication Data
US 2021/0036391 A1 Feb. 4, 2021

(51) Int. Cl.
*H01P 1/213* (2006.01)
*H01P 1/207* (2006.01)

(52) U.S. Cl.
CPC ..... *H01P 1/2138* (2013.01); *H01P 1/207* (2013.01)

(58) Field of Classification Search
CPC ..... H01P 1/201; H01P 1/202; H01P 1/207; H01P 1/2138; H01P 1/213
USPC ..... 333/132, 238, 245, 246, 248
See application file for complete search history.

(56) References Cited

U.S. PATENT DOCUMENTS

2012/0293282 A1* 11/2012 Frenna ..... H01P 1/207 333/209

FOREIGN PATENT DOCUMENTS

WO 2013036485 A1 3/2013
WO 2017084695 A1 5/2017

OTHER PUBLICATIONS

Huang, X. et al., "Electronic Tunable Diplexer with Wide Tuning Range", 2016 Progress in Electromagnetic Research Symposium (PIERS), Aug. 8, 2016, pp. 3511-3514, IEEE.
Lee, B. et al., "Frequency-Tunable Filtering Power Divider with New Topology", IEEE Transactions on Components, Packaging and Manufacturing Technology, vol. 7 No. 7, Jul. 1, 2017, pp. 1151-1162, IEEE.

* cited by examiner

*Primary Examiner* — Rakesh B Patel
*Assistant Examiner* — Jorge L Salazar, Jr.
(74) *Attorney, Agent, or Firm* — Coats & Bennett, PLLC

(57) ABSTRACT

A tunable diplexer arrangement (100) comprising a first filter arrangement (110) and a second filter arrangement (120) connected to respective first (115) and second (125) filter ports of a junction (130), the junction comprising a common port (140), wherein at least the first filter arrangement (110) is a tunable filter comprising a first tuning element (111), wherein the junction (130) comprises a first junction tuning element (112) corresponding to the first tuning element (111) and arranged in connection to the second filter port (125), thereby enabling a tunable matching of the junction (130) with respect to a first frequency characteristic of the first filter arrangement (110).

17 Claims, 3 Drawing Sheets

TUNABLE DIPLEXER JUNCTION

TECHNICAL FIELD

The present disclosure relates to tunable diplexer arrangements suitable for use with tunable filters in radio frequency transceivers.

BACKGROUND

Wireless communication networks comprise radio frequency transceivers, such as radio base stations used in access networks that serve wireless devices, and microwave radio link transceivers used for, e.g., backhaul into a core network.

Radio transceivers, in general, comprise antenna devices. There is often one radio branch connected to the antenna device arranged for transmission, and another radio branch connected to the antenna device arranged for reception.

The antenna device is usually connected to the transmission branch and to the reception branch via a diplexer arrangement that comprises a first band-pass filter that is connected to the reception branch, and a second band-pass filter that is connected to the transmission branch. A three-port junction connects the transmit and receive branches to the antenna device.

Such a diplexer is relatively expensive to manufacture and constitutes a quite space-consuming component. Furthermore, radio equipment such as microwave radio transceivers are manufactured and sold for many different frequency bands, and it is necessary to have one specific diplexer per frequency band, due to the frequency dependency of components.

There is a need for diplexer arrangements and radio systems which are more versatile and that can be used for more than one specific frequency configuration. WO2017084695 A1 discloses a tunable antenna connector arrangement which can be re-configured for different filter characteristics.

SUMMARY

It is an object of the present disclosure to provide improved diplexer arrangements, radio transceivers, and methods in tunable diplexer arrangements.

This object is obtained by a tunable diplexer arrangement comprising a first filter arrangement and a second filter arrangement connected to respective first and second filter ports of a junction. The junction comprises a common port, wherein at least the first filter arrangement is a tunable filter comprising a first tuning element. The junction comprises a first junction tuning element corresponding to the first tuning element and arranged in connection to the second filter port, thereby enabling a tunable matching of the junction with respect to a first frequency characteristic of the first filter arrangement.

This way, a tuning of the first filter arrangement frequency characteristics, e.g., a tuning of center frequency of the first filter arrangement, does not cause mismatch in the junction as before with known junctions, since the disclosed junction can be tuned to match the new frequency characteristic of the first filter arrangement by operating the first junction tuning element. This way, return loss an insertion loss performance of the tunable diplexer arrangement is improved. Also, it is no longer necessary to have one specific diplexer per frequency band, which conserves cost and simplifies, e.g., maintenance and system testing.

According to aspects, a distance from the second filter port to a point inside the junction is arranged to be electromagnetically tunable by the first junction tuning element.

By the tuning of the distance, improved matching of the junction is obtained despite the variable frequency characteristics of the first filter arrangement. When the frequency characteristics of the first filter arrangement is changed, the matching of the junction can be maintained by varying the tunable distance of the junction to account for the new frequency characteristics of the first filter arrangement.

According to aspects, the second filter arrangement is a tunable filter comprising a second tuning element. The junction comprises a second junction tuning element corresponding to the second tuning element and arranged in connection to the first filter port, thereby enabling a tunable matching of the junction with respect to a second frequency characteristic of the second filter.

This way a diplexer function is obtained with tunable filter characteristics on both filter arrangements. Matching of the junction can be maintained despite the tunable filter characteristics on both filter arrangements by operating the first and second junction tuning elements. This way improved return loss and insertion loss performance of the diplexer arrangement is obtained compared to known diplexer arrangements comprising tunable filter arrangements.

According to aspects, the junction comprises a delimiting element arranged between the first and the second filter port. The delimiting element is a design choice improving overall diplexer performance in terms of, e.g., return loss.

According to aspects, the delimiting element and the first filter port define a first junction resonator corresponding to a resonator of the second filter arrangement, wherein the delimiting element and the second filter port define a second junction resonator corresponding to a resonator of the first filter arrangement. Due to that the junction resonators correspond to the filter resonators, a tuning of the junction to match a tuning of the filter arrangements is simplified in that, essentially, the same tuning operation is suitable for both junction and filters. This simplifies control of the tunable diplexer arrangement to obtain improved matching.

According to aspects, the first tuning element and the first junction tuning element are arranged to be connected to a first shared tuning actuator. This way the number of components is reduced, which is cost effective and allows for simplified control in that only one tuning actuator needs to be operated to control both the first junction tuning element and the first tuning element.

According to aspects, the second tuning element and the second junction tuning element are arranged to be connected to a second shared tuning actuator. This way the number of components is further reduced, which is cost effective and allows for simplified control in that only two tuning actuators need to be operated to control both the first and second junction tuning elements and the first and second tuning elements. Thus, two tuning actuators are used to control tuning of the filters, and adjust the junction to maintain matching with respect to the present frequency tuning of the filters.

There are also disclosed herein transceiver devices and methods associated with the above mentioned benefits and advantages.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

The present disclosure will now be described more in detail with reference to the appended drawings, where.

DETAILED DESCRIPTION

Figure 1:
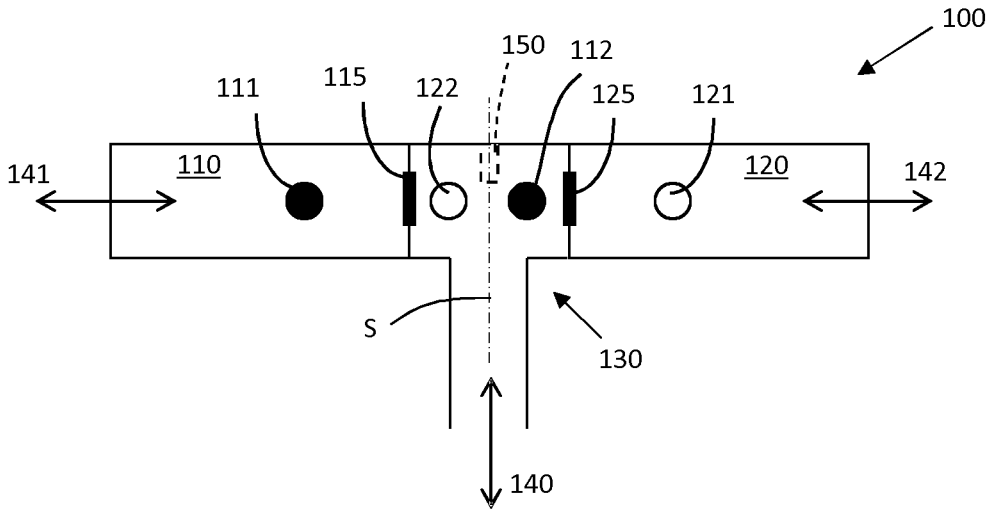
FIGS. 1-4 schematically show tunable diplexer arrangements.

The invention will now be described more fully hereinafter with reference to the accompanying drawings, in which certain aspects of the invention are shown. This invention may, however, be embodied in many different forms and should not be construed as limited to the embodiments and aspects set forth herein; rather, these embodiments are provided by way of example so that this disclosure will be thorough and complete, and will fully convey the scope of the invention to those skilled in the art. Like numbers refer to like elements throughout the description.

A diplexer is a device that implements frequency-domain multiplexing. Two ports are multiplexed onto a common port. The signals on the two ports occupy disjoint frequency bands. Consequently, the signals on the two ports can coexist on the common port without interfering with each other.

A duplexer is a device that allows bi-directional (duplex) communication over a single path. In radar and radio communications systems, the duplexer isolates the receiver from the transmitter while permitting them to share a common antenna via a common port of a diplexer. Duplexers are often based on frequency and comprise waveguide filters, but duplexers can also be based on polarization and sometimes also time. The communication systems considered herein are based on frequency duplexing.

Herein, frequency characteristics of a filter arrangement refers to the frequency response of the filters, i.e., which frequency components that are passed by the filter, and which frequency components that are attenuated by the filter arrangement.

A microwave radio link is a radio link that often is arranged between two fixed points. Such radio links are sometimes referred to as point-to-point radio links, and are often used in backhaul applications, i.e., to connect a radio base station, or similar, to a core network.

Diplexers/Duplexers used for microwave radio links are normally based on air-filled waveguides. They consist of at least two band pass filters whose dimensions are dependent on the selected frequency band of communication. The center frequency distance between the two filters, i.e., transmit filter TX and receive filter RX, is dependent on regulatory requirements, such as the regulations of the European Telecommunications Standards Institute (ETSI), and varies for different locations in the world.

In order to provide filter arrangements which can be used in different frequency bands using the same hardware, tunable filter arrangements have been implemented. The tunable filter arrangements operate by, e.g., inserting metal or di-electric tuning elements into resonance chambers of the filters, thereby changing frequency characteristics of the filter. Such filters are known from, e.g., WO2017084695 A1, and will not be discussed in detail here.

The space between the reception frequency band and the transmission frequency band is called duplex distance. Signals within the transmission frequency band are not wanted in signals within the reception frequency band, since these constitute undesired interference.

It is difficult to design a wide band solution with tunable filters in a diplexer with respect to different duplex distances. This will often require different hardware per duplex. Diplexers containing tunable filters with different duplex distances therefore normally have unique hardware per duplex, despite the tunable property of the filters.

Herein, a solution is proposed which reduces or removes the need for unique hardware per duplex distance. A tunable junction is described which can be adapted to the frequency characteristics of the tunable filters as they are tuned to different frequency bands of transmission and reception.

A tunable length is introduced at each side of the junction just before the filter ports. The tunable length is an electromagnetically equivalent length, i.e., a length which, at a given frequency band, corresponds to a length of an air-filled waveguide section or similar. Changing electromagnetically equivalent length can be achieved by, e.g., inserting a tuning element, made of a di-electric or of a metal, into a resonance section or chamber of a waveguide design or resonance structure. Herein, when discussing distances, it is appreciated that electromagnetically equivalent distances are discussed.

Figure 3:
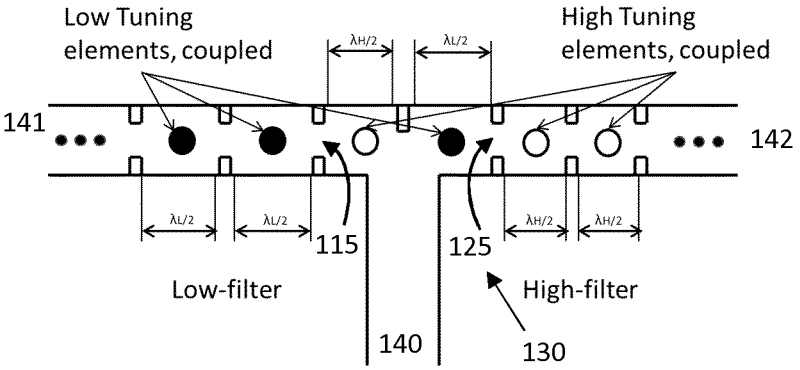

An example of the above is schematically illustrated in FIG. 3. Here, the tunable diplexer arrangement comprises a first filter arrangement configured as a low frequency bandpass filter, Low-filter, and a second tunable filter arrangement configured as a high frequency bandpass filter, High-filter. The tunable lengths are shown as half-wavelengths AL/2 and AH/2. The Low-filter comprises resonance cavities, or resonance chambers with dimensions set in relation to wavelength AL corresponding to a center frequency fL of the Low-filter. The High-filter also comprises resonance cavities, or resonance chambers, but with dimensions set in relation to wavelength AH corresponding to a center frequency fH of the High-filter. The junction tuning elements are shown as coupled to the filter tuning elements. Thus, the left-hand side junction tuning elements are coupled to the tuning elements of the High-filter, while the right-hand side junction tuning element is shown as coupled to the tuning elements off the Low-filter. Thus, as the frequency characteristics of the first and second filter arrangement is are changed by the filter tuning elements, the matching of the junction is maintained by the junction tuning elements coupled to the filter tuning elements.

FIG. 1 schematically illustrates a tunable diplexer arrangement 100 comprising a first filter arrangement 110 and a second filter arrangement 120 connected to respective first 115 and second 125 filter ports of a junction 130. The junction also comprises a common port 140, for, e.g., connecting the diplexer to an antenna or other communication interface. At least the first filter arrangement 110 is a tunable filter comprising a first tuning element 111. This tuning element is, according to aspects, a rod arranged to be inserted into the diplexer arrangement at variable depth, thus altering electromagnetical properties of the filter arrangement to vary, e.g., a center frequency of the first filter arrangement frequency characteristics. The junction 130 comprises a first junction tuning element 112 corresponding to the first tuning element 111 and arranged in connection to the second filter port 125. Since the first junction tuning element corresponds to the first tuning element of the first filter arrangement, a variation in, e.g., depth of the two tuning elements has corresponding effects on the electromagnetical properties of resonators of the filter and of the junction. This way, a tunable matching of the junction 130 with respect to a first frequency characteristic of the first filter arrangement 110 is enabled. The first frequency characteristic may, according to aspects, comprise a center frequency of the filter arrangement, a bandwidth, or some other frequency characteristic describing a frequency response of the first filter arrangement 110.

Figure 4:
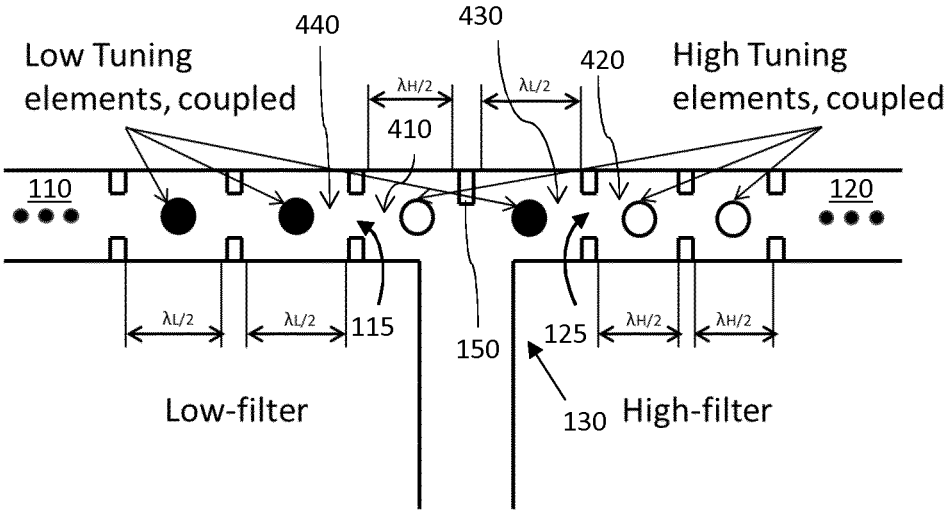

It is noted that FIG. 3 and FIG. 4 show the first and second filter ports as filter irises, i.e., waveguide openings leading into the filter arrangement interior. It is, however, appreciated that the first and second filter ports can be realized in a number of different ways, e.g., using posts or other known waveguide filter interface designs.

According to some aspects, the first junction tuning element 112 being arranged in connection to the second filter port 125 means that the first junction tuning element 112 is arranged closer to the second filter port 125 than to the first filter port 115.

According to some aspects, the first junction tuning element 112 being arranged in connection to the second filter port 125 means that the first junction tuning element 112 is arranged on the same side of a symmetry line S of the junction 130 as the second filter port 125, where the symmetry line S divides the tunable diplexer arrangement 100 in two parts. The symmetry line S is shown in, e.g., FIG. 1.

According to other aspects, the first junction tuning element 112 being arranged in connection to the second filter port 125 means that the first junction tuning element 112 is arranged closer to the second filter port 125 than to the first filter port 115.

The purpose of the first junction tuning element 112 being arranged in connection to the second filter port 125 is to provide for matching of the junction despite frequency tuning of the first filter arrangement 110.

This means that if the frequency characteristics of the first filter arrangement is changed by means of the first tuning element 111, then a corresponding matching change can be obtained by using the first junction tuning element 112. This is advantageous since matching for certain frequency characteristics will deteriorate if the frequency characteristics is changed. Matching of the junction with respect to the first filter arrangement can therefore be maintained by means of the first junction tuning element 112 as the frequency characteristics of the first filter arrangement is changed by means of the first junction tuning element 111.

The first filter arrangement is arranged to interface with a transceiver via port 141, while the second filter arrangement is arranged to interface with the transceiver via port 142.

To understand the underlying principle, it is appreciated that the tuning action of the first junction tuning element 112 is to change a distance, i.e., an electromagnetically equivalent distance, inside the junction, to match a frequency characteristic of the first filter arrangement 110. Consequently, a distance from the second filter port 125 to a point inside the junction 130 is arranged to be electromagnetically tunable by the first junction tuning element 112. In known diplexer arrangements without tunable filters, this distance inside the junction is designed to achieve good overall matching in the diplexer, i.e., to optimize return loss and insertion loss performance. However, when the filter arrangements are tuning to different frequency characteristics, the matching of the junction is lost, since the distance is no longer optimal. In order to avoid reduced performance in terms of insertion loss and return loss of the diplexer arrangement, the distance is tuned to match the new frequency characteristics of the filter arrangements. This way overall matching of the diplexer arrangement is maintained despite the frequency tuning.

FIG. 1 also shows a second filter arrangement with corresponding tuning element and junction tuning element. According to aspects, the second filter arrangement 120 is also a tunable filter comprising a second tuning element 121. The junction 130 comprises a second junction tuning element 122 corresponding to the second tuning element 121 and arranged in connection to the first filter port 115, thereby enabling a tunable matching of the junction 130 with respect to a second frequency characteristic of the second filter 120. Thus, by operating the first junction tuning element 112 and second 122 junction tuning element, the junction can be matched to a varying frequency characteristic of the first 110 and second 120 filter arrangements.

According to some aspects, the second junction tuning element 122 being arranged in connection to the second filter port 115 means that the second junction tuning element 122 is arranged closer to the first filter port 115 than to the second filter port 125.

According to some aspects, the second junction tuning element 122 being arranged in connection to the first filter port 115 means that the second junction tuning element 122 is arranged on the same side of a symmetry line S as the first filter port 115, where the symmetry line S divides the tunable diplexer arrangement 100 into two sections.

The filter ports 115, 125 are according to some aspects constituted by iris openings delimited by corresponding ridges or filter posts in a well-known manner.

Figure 2:
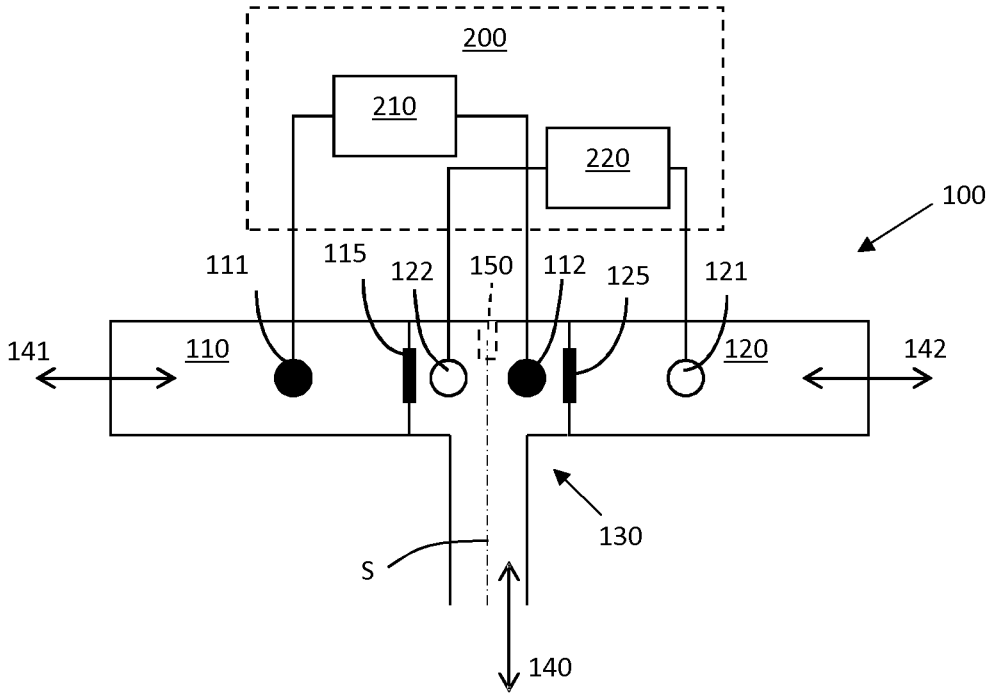

With reference to FIG. 2, the first tuning element 111 and the first junction tuning element 112 are, according to aspects, arranged to be connected to a first shared tuning actuator 210. The tuning mechanism on, e.g., TX-side of the junction will thus use a similar tuning element as that in the RX-filter. This solution means that no extra step motor is required for implementation of a wide band tunable Diplexer, since the step or piezoelectric motor on TX side can be used to control the distance before the RX-filter.

According to aspects, the second tuning element 121 and the second junction tuning element 122 are arranged to be connected to a second shared tuning actuator 220.

The tuning mechanism on, e.g., RX-side of the junction will consequently use a similar tuning element as that in the TX-filter. This solution means that no extra step motor is required for a wide band tunable Diplexer, since the step motor on RX side can be used to control the distance before the TX-filter.

The relative positions of the tuning elements, i.e., filter tuning elements and junction tuning elements are optimized to obtain a linear tuning and the depth of penetration of the tuning elements set the resonant frequency of the filters. A step-motor or a piezoelectric motor can be used to control the depth of the tuning element and by that control the center frequency of the filter arrangement.

Traditionally, in known filter arrangements there is a mis-match due to reflections in the 'opposite' filter when tunable filters are used. This means that there are frequency dependent variants for different duplex distances. One main purpose of tunable diplexers is to avoid hardware variants. For instance, a 340 MHz duplex distance and a 1000 MHz duplex distance cannot share junction, which means that different hardware is required for the different duplex distances. The need for duplex distance dependent hardware is removed or reduced by the techniques presented herein. Novel junction tuning devices are introduced to compensate for the effect of the tunable filters as the tunable filters are re-configured to different frequency characteristics. This way, matching in the junction can maintained despite tuning the filters, which means that junction hardware need not be dependent on duplex distance.

By the presented arrangements, improved filter performance is obtained. For instance, return loss and insertion loss performance metrics are improved compared to known filter arrangements.

FIG. 1 also shows an optional delimiting element 150, arranged inside the junction 130. This delimiting element is used to shape the frequency characteristics of the junction, and of the tunable diplexer arrangement in general. The delimiting element is arranged between the first 115 and the second 125 filter port.

According to some aspects, the first junction tuning element 112 being arranged in connection to the second filter port 125 means that the first junction tuning element 112 is arranged on a side of the delimiting element closer to the second filter port 125 than to the first filter port 115.

With reference to FIG. 4, according to aspects, the delimiting element 150 and the first filter port 115 defines a first junction resonator 410 corresponding to a resonator geometry 420 of the second filter arrangement 120.

According to aspects, the delimiting element 150 and the second filter port 125 defines a second junction resonator 430 corresponding to a resonator geometry 440 of the first filter arrangement 110.

It is appreciated that the resonator geometry referred to is part of the filtering functions of the first and second filter arrangements, respectively. For instance, the resonator geometry may correspond to a resonance chamber or resonance cavity.

According to aspects, the delimiting element 150 is a ridge extending from a wall of the junction.

According to aspects, the delimiting element 150 is a post arranged inside the junction.

As noted above, according to aspects, any of the first and second tuning element 111, 121, and the first and second junction tuning element 112, 122, is metal tuning element arranged movably in relation to the tunable diplexer arrangement.

Also, any of the first and second tuning element 111, 121, and the first and second junction tuning element 112, 122, is a dielectric tuning element arranged movably in relation to the tunable diplexer arrangement.

A combination of metal and dielectric tuning elements can be used in the tunable diplexer arrangement 100.

Figure 5:
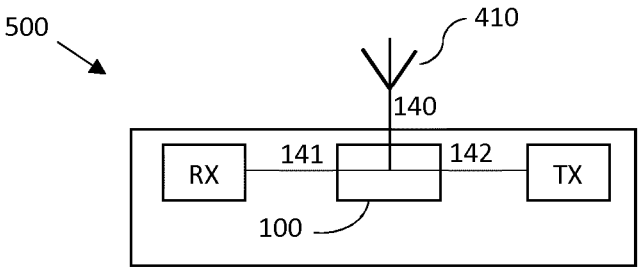
FIG. 5 schematically shows a transceiver device.

FIG. 5 schematically illustrates a transceiver device 500 arranged to transmit and to receive radio frequency signals, comprising the tunable diplexer arrangement 100 according to the above discussion. Here, an example arrangement is shown where an RX radio chain connects to the first filter arrangement via port 141 and a TX radio chain connects to the second filter arrangement via port 142. An antenna 410 is shown as connected to the common port 140.

The above discussed tunable diplexer arrangements are performing methods according to embodiments. Such methods are illustrated in FIG. 6.

Figure 6:
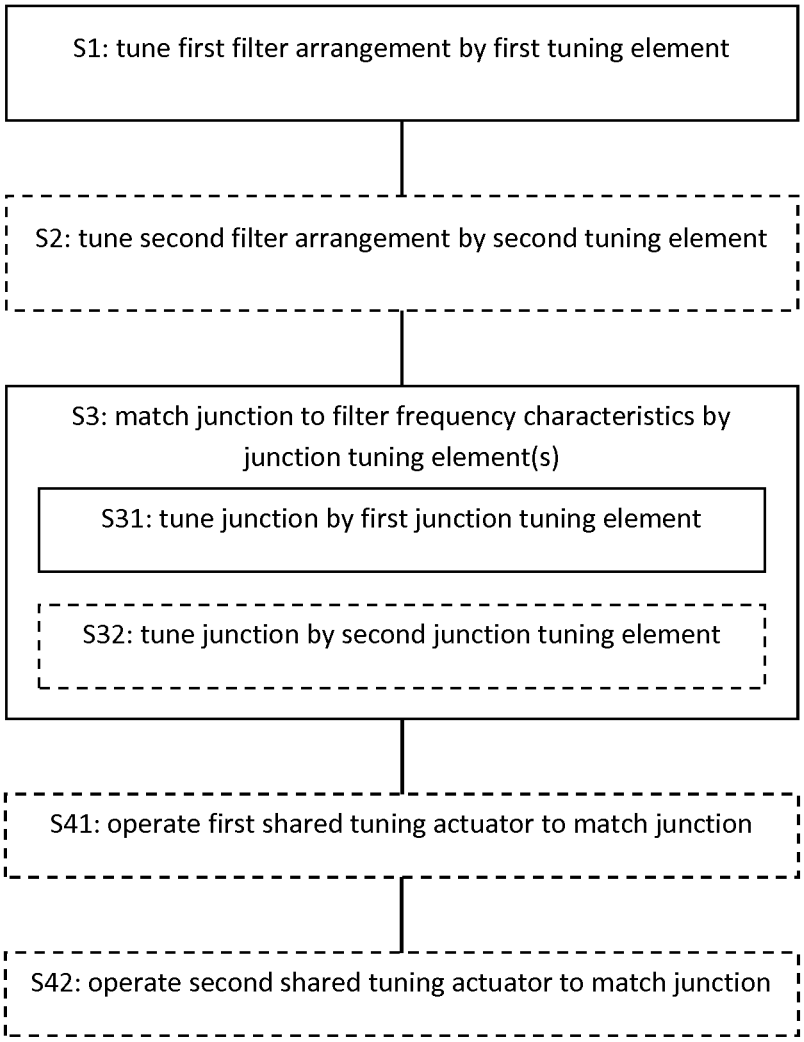
FIG. 6 shows a flowchart illustrating methods.

FIG. 6 shows a method in a tunable diplexer arrangement 100 comprising a first filter arrangement 110 and a second filter arrangement 120 connected to respective first 115 and second 125 filter ports of a junction 130. The junction comprising a common port 140 arranged to be connected to an antenna. The method comprises tuning S1 the first filter arrangement 110 by a first tuning element 111 to obtain a first frequency characteristic of the first filter arrangement, matching S3 the junction 130 to the first frequency characteristic of the first filter arrangement, wherein the matching comprises tuning S31 the junction 130 to the first frequency characteristic of the first filter arrangement by a first junction tuning element 112 corresponding to the first tuning element 111 and arranged in connection to the second filter port 125.

According to aspects, the method also comprises tuning S2 the second filter arrangement 120 by a second tuning element 121 to obtain a second frequency characteristic of the second filter arrangement, wherein the matching S3 comprises tuning S32 the junction 130 to the second frequency characteristic of the second filter arrangement by a second junction tuning element 122 corresponding to the second tuning element 121 and arranged in connection to the first filter port 115.

Embodiments of the tunable diplexer arrangement was discussed above in connection to FIGS. 1-5.

According to aspects, tuning S1 the first filter arrangement by the first tuning element 111 and tuning the junction S31 by the first junction tuning element 112 comprises operating S41 the first tuning element 111 and the first junction tuning element 112 by a first shared tuning actuator 210.

According to aspects, tuning S2 the second filter arrangement by the second tuning element 121 and tuning the junction S42 by the second junction tuning element 122 comprises operating S42 the second tuning element 121 and the second junction tuning element 122 by a second shared tuning actuator 220.

The first and second shared tuning actuators were discussed above in connection to FIG. 2.

The invention claimed is:

1. A tunable diplexer arrangement, comprising:

a first waveguide filter arrangement and a second waveguide filter arrangement connected to respective first and second filter ports of a junction; wherein the junction comprises a common port;

wherein at least the first waveguide filter arrangement is a tunable filter comprising a first tuning element;

wherein the junction comprises a first junction tuning element corresponding to the first tuning element and arranged in connection to the second filter port, thereby enabling a tunable matching of the junction with respect to a first frequency characteristic of the first waveguide filter arrangement.

2. The tunable diplexer arrangement of claim 1, wherein a distance from the second filter port to a point inside the junction is configured to be electromagnetically tunable by the first junction tuning element.

3. The tunable diplexer arrangement of claim 1:

wherein the second waveguide filter arrangement is a tunable filter comprising a second tuning element;

wherein the junction comprises a second junction tuning element corresponding to the second tuning element and arranged in connection to the first filter port, thereby enabling a tunable matching of the junction with respect to a second frequency characteristic of the second filter.

4. The tunable diplexer arrangement of claim 3, wherein at least one of the first tuning element, the second tuning element, the first junction tuning element, and the second junction tuning element is a metal tuning element arranged movably in relation to the tunable diplexer arrangement.

5. The tunable diplexer arrangement of claim 3, wherein at least one of the first tuning element, the second tuning element, the first junction tuning element, and the second junction tuning element is a dielectric tuning element arranged movably in relation to the tunable diplexer arrangement.

6. The tunable diplexer arrangement of claim 3, wherein the second tuning element and the second junction tuning element are configured to be connected to a second shared tuning actuator.

7. The tunable diplexer arrangement of claim 1, wherein the junction comprises a delimiting element arranged between the first and the second filter port.

8. The tunable diplexer arrangement of claim 7:

wherein the delimiting element and the first filter port define a first junction resonator corresponding to a resonator of the second waveguide filter arrangement;

wherein the delimiting element and the second filter port define a second junction resonator corresponding to a resonator of the first waveguide filter arrangement.

9. The tunable diplexer arrangement of claim 7, wherein the delimiting element is a ridge.

10. The tunable diplexer arrangement of claim 7, wherein the delimiting element is a post.

11. The tunable diplexer arrangement of claim 1, wherein the first tuning element and the first junction tuning element are configured to be connected to a first shared tuning actuator.

12. A transceiver device configured to transmit and to receive radio frequency signals, the transceiver device comprising:

a tunable diplexer arrangement, the tunable diplexer arrangement comprising:

a first waveguide filter arrangement and a second waveguide filter arrangement connected to respective first and second filter ports of a junction; wherein the junction comprises a common port;

wherein at least the first waveguide filter arrangement is a tunable filter comprising a first tuning element;

wherein the junction comprises a first junction tuning element corresponding to the first tuning element and arranged in connection to the second filter port, thereby enabling a tunable matching of the junction with respect to a first frequency characteristic of the first waveguide filter arrangement.

13. The transceiver device of claim 12:

wherein the second waveguide filter arrangement is a tunable filter comprising a second tuning element;

wherein the junction comprises a second junction tuning element corresponding to the second tuning element and arranged in connection to the first filter port, thereby enabling a tunable matching of the junction with respect to a second frequency characteristic of the second filter.

14. A method in a tunable diplexer arrangement; wherein the tunable diplexer arrangement comprises a first waveguide filter arrangement and a second waveguide filter arrangement connected to respective first and second filter ports of a junction; wherein the junction comprises a common port configured to be connected to an antenna; the method comprising:

tuning the first waveguide filter arrangement by a first tuning element to obtain a first frequency characteristic of the first waveguide filter arrangement;

matching the junction to the first frequency characteristic of the first waveguide filter arrangement, wherein the matching comprises tuning the junction to the first frequency characteristic of the first waveguide filter arrangement by a first junction tuning element corresponding to the first tuning element and arranged in connection to the second filter port.

15. The method of claim 14:

further comprising tuning the second waveguide filter arrangement by a second tuning element to obtain a second frequency characteristic of the second waveguide filter arrangement;

wherein the matching further comprises tuning the junction to the second frequency characteristic of the second waveguide filter arrangement by a second junction tuning element corresponding to the second tuning element and arranged in connection to the first filter port.

16. The method of claim 15, wherein the tuning the second waveguide filter arrangement by the second tuning element and tuning the junction by the second junction tuning element comprises operating the second tuning element and the second junction tuning element by a second shared tuning actuator.

17. The method of claim 14, wherein tuning the first waveguide filter arrangement by the first tuning element and tuning the junction by the first junction tuning element comprises operating the first tuning element and the first junction tuning element by a first shared tuning actuator.

* * * * *